US005799993A

United States Patent [19]

Lafferty

[11] Patent Number: 5,799,993

[45] Date of Patent: Sep. 1, 1998

[54] REFUSE COLLECTING DEVICE

[76] Inventor: Owen W. Lafferty, P.O. Box 1702, Pampa, Tex. 79065

[21] Appl. No.: 835,181

[22] Filed: Apr. 7, 1997

[51] Int. Cl.[6] ..... A01K 29/00; E01H 1/12

[52] U.S. Cl. ..... 294/1.4; 15/257.4

[58] Field of Search ..... 294/1.1, 1.3–1.5, 294/53.5, 55; 15/104.8, 257.1–257.7; 248/95, 99–101

[56] References Cited

U.S. PATENT DOCUMENTS

| | | | |
|---|---|---|---|
| D. 285,012 | 8/1986 | Willis | 294/1.4 X |
| 2,237,836 | 4/1941 | Macaluso | 15/257.4 |
| 3,827,098 | 8/1974 | Sanderson | 294/1.4 |
| 4,149,745 | 4/1979 | Willis | 294/1.4 |
| 4,279,437 | 7/1981 | Goldbarg | 294/1.4 |
| 4,986,587 | 1/1991 | Lozano | 294/1.4 |
| 5,343,589 | 9/1994 | Davenport | 15/257.4 |

*Primary Examiner*—Johnny D. Cherry
*Attorney, Agent, or Firm*—Norman B. Rainer

[57] ABSTRACT

A refuse collecting device which removably secures a disposable handle-equipped sack includes a scoop of rectangular box-like configuration having front and rear openings, and structure for engaging the handles of the sack. An elongated manipulating staff is pivotably secured to the scoop in a manner such that, when the device is lifted, the scoop automatically swings by gravity effect, causing the front opening to become upwardly directed.

7 Claims, 1 Drawing Sheet

REFUSE COLLECTING DEVICE

BACKGROUND OF THE INVENTION

1. Field of the Invention

The present invention relates to refuse collecting devices and, more particularly, to devices for collecting and disposing of the feces of pets.

2. Description of the Prior Art

Periodically and usually daily, home owners who have pets such as dogs and cats, must remove the feces of their pets from their yards. Often, the feces is picked up with a spade, shovel, hand trowel, or the like. Thereafter, the feces is placed within a container of some sort and ultimately dumped into a garbage can or toilet. These implements are reasonably satisfactorily useable but the process is more cumbersome than need be. Additionally, for those persons who, because of physical fraility or injury, cannot easily stoop or bend over, adequate manipulation of the implements may be difficult. Moreover, the process of depositing the picked-up feces into a container is cumbersome and at best, somewhat awkward and distasteful.

Many municipalities, particularly those without a large park system, impose severe fines upon the owners of pets who allow their pets to defecate on the sidewalk. Accordingly, owners who exercise their pets on public sidewalks must carry with them some means for retrieving their pet's feces or else be subject to substantial fines.

In most neighborhoods, there are, despite the most stringent leash laws, animals which roam unattended. Necessarily, these animals defecate on property other than that of their owner's. The results are not only unsightly but also hazardous to health. Removal of such feces must be effected by the property owner.

The following United States Letters Patents disclose various types of devices which have been invented and which are generally related to the present invention: U.S. Pat. Nos. 3,659,891, 3,703,158, 3,740,086, 3,744,453, 3,754,785, 3,757,737, 3,777,708, 3,804,448, 3,830,423, 3,868,135 and 3,986,744.

While these devices will, to a greater or a lesser extent, accomplish the purposes sought, they suffer from various mechanical and operational deficiencies. For example, some of the devices require specially constructed and formed collection bags; thereby, bags readily available in one's household cannot be employed. Some of the devices have attachment mechanisms for the collection bags which render detachment of the filled collection bag difficult or which render it necessary to physically contact portions of the device contaminated with the feces picked up. For those devices which have no removable collection bag, the cleaning required to remove the collected feces is extremely distasteful, particularly if the user does not live in a house where outside faucets are available.

The present invention was developed with full knowledge of the state of the prior art, and particular emphasis was directed toward the development of a device which is first of all functionally adequate, employs disposable collection bags of a type available in any household, and may be more easily and cleanly manipulated.

It is therefore a primary object of the present invention to provide a device for collecting animal feces in a disposable collection bag.

Another object of the present invention is to provide a refuse collection device which may be operated by manipulation of an extended handle.

Yet another object of the present invention is to provide a refuse collecting device which detachably secures a commonly available type of plastic sack.

It is a further object of this invention to provide a refuse collecting device of the aforesaid nature which removably accommodates a plastic bag in a manner causing the bag to cover substantially all portions of the device that may contact the animal feces.

It is a still further object of the present invention to provide a device of the aforesaid nature of simple, rugged construction amenable to low cost manufacture.

These objects and other objects and advantages of the invention will be apparent from the following description.

SUMMARY OF THE INVENTION

The above and other beneficial objects and advantages are accomplished in accordance with the present invention by a refuse collecting device adapted to removably secure a disposable sack, said device comprising:

a) a scoop of rectangular box-like configuration comprised of upper and lower panels and opposed side panels, said panels having exterior surfaces and inner surfaces which define an interior region of the scoop having a center axis of elongation, said panels terminating in coplanar forward edges which define a rectangular front opening, and coplanar back edges defining a rectangular rear opening, b) at least one sack-securing means associated with the exterior surface of each side panel, c) a manipulating staff extending between proximal and distal extremities, said proximal extremity being pivotally secured to said upper panel adjacent said front opening, said manner of securement permitting a path of movement of said staff within a plane that includes said axis, and d) handle means orthogonally associated with the distal extremity of said staff and downwardly directed therefrom a manner to lie within said path of movement.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
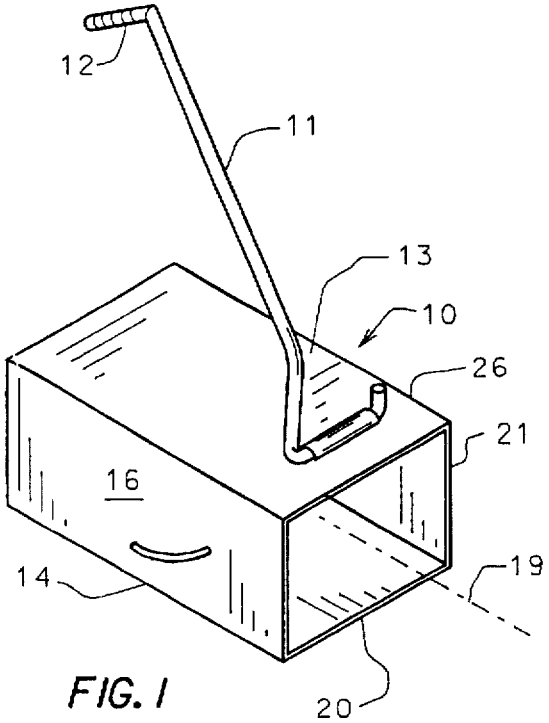
FIG. 1 is a top and front perspective view of an embodiment of the refuse collecting device of this invention shown in its ground-contacting operational mode.
Figure 2:
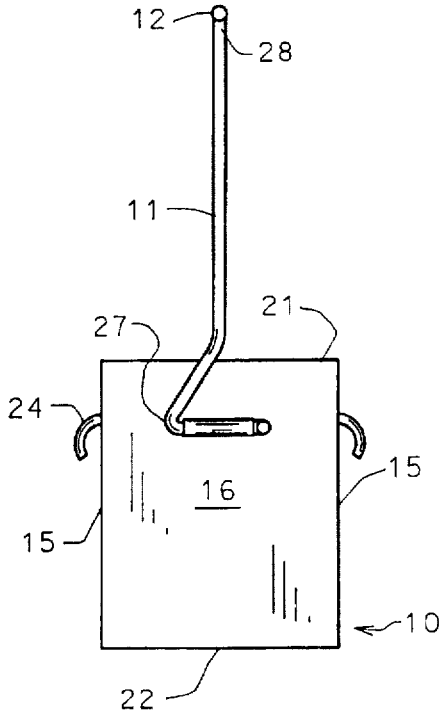
FIG. 2 is a side view of the embodiment of FIG. 1 shown in its vertically oriented lifted mode.
Figure 3:
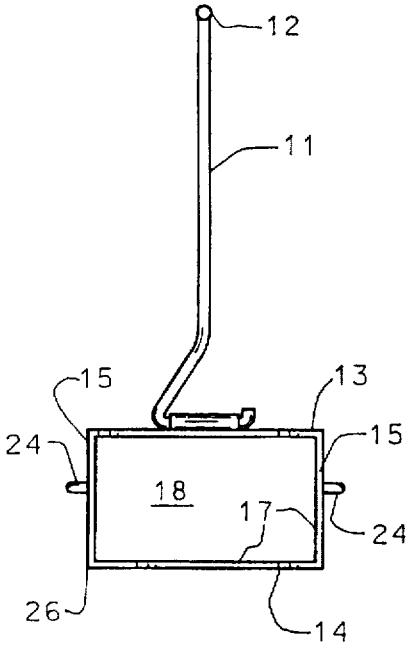
FIG. 3 is a front view.
Figure 4:
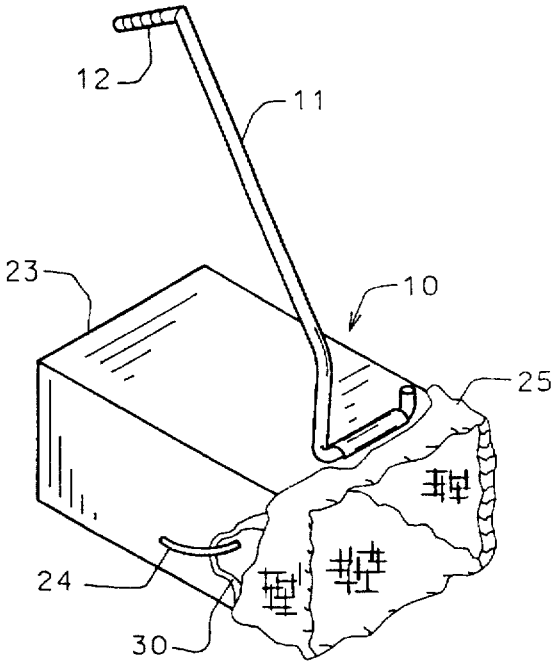
FIG. 4 is a perspective view similar to FIG. 1 showing the device in functional engagement with a disposable plastic sack.

Referring to FIGS. 1–4, an embodiment of the refuse collecting device is shown comprised of a scoop 10 having an attached manipulating staff 11 equipped with handle means 12.

Scoop 10 is of rectangular box-like configuration, comprised, of upper and lower panels 13 and 14, respectively, and opposed side panels 15. The panels may be further characterized in having exterior surfaces 16 and inner surfaces 17 which define an interior region 18 having a center axis of elongation 19. The panels terminate in coplanar forward edges 20 which define a rectangular front opening 21, and coplanar back edges 22 which define a rectangular rear opening 23 disposed in parallel relationship to said front opening. Such box-like configuration is further characterized in having four parallel corner edges 26. Securing means in the form of outwardly and rearwardly directed hooks 24 protrude outwardly from the exterior surfaces of said side panels.

The purpose of said securing means is to hold a disposable plastic sack 25 in close engagement with the scoop, as will be detailed hereinafter. Alternative embodiments of securing means include clamping devices, recesses within the sidewall, and ear members integral with the sidewall and outwardly bent therefrom. The panels are fabricated of rigid, strong, lightweight and non-corrosive material such as aluminum and plastics. The scoop may be of monolithic construction, as may be fabricated in a molding or bending and joining operation. The configuration of the scoop may be such that the upper and lower panels are wider than the side panels, thereby causing the front opening to be elongated transversely with respect to axis 19. The widths of the panels, measured orthogonally between respective corner edges 26, may range between about 6 and 12 inches. The length of the scoop, measured axially between said front and rear openings may range between about 7 and 12 inches, and is preferably longer than the width of the panels.

Manipulating staff 11 is preferably a rigid rod that extends between proximal and distal extremities, 27 and 28, respectively. Said proximal extremity is pivotally secured to upper panel 13 adjacent front opening 21. The manner of securement of the staff is such as to permit a path of movement of said staff in a plane that includes axis 19. Also, the site of securement of the staff is such that, when the device is lifted, scoop 10 will automatically swing by gravity effect such that front opening 21 becomes upwardly directed. The diameter of the rod which constitutes staff 11 may be between about ¼" and ⅜", and may have a length between about 24 and 36 inches. In some embodiments, the staff may be of telescopically adjustable length to suit the height of the user.

Handle means 12 is orthogonally associated with the distal extremity of staff 11, and is downwardly directed therefrom in a manner to lie within said path of movement. Said handle means is preferably fabricated by the bending of staff 11, and is then overcoated with structure that increases the effective diameter of the rod.

The size and configuration of the scoop is such as to precisely accommodate a standard plastic grocery sack 25. Such disposable sacks are generally fabricated of thin but strong polypropylene film and provided with paired carrying handles 30 as integral components of the sack. The securing means 24 on scoop 10 are positioned and configured so as to engage said carrying handles. When the carrying handles are thereby engaged, the plastic sack is then disposed forwardly upon the exterior surfaces of the scoop, over front opening 21, and inwardly into interior region 18. The bottom of sack 24 is thereby disposed either within interior region 18 or rearwardly of rear opening 23. By virtue of such manner of disposition of the sack upon the scoop, all portions of the scoop that would otherwise contact the fecal refuse are protected from soiling, and the sacks are easily removed for disposal.

In use, the device is employed such that lower panel 14 of the scoop is rested upon the ground in front of a fecal deposit which is then pushed into the scoop with a small rake or other elongated implement of a disposable or re-useable nature. When the device is lifted by said handle means, the scoop automatically pivots, causing the collected refuse to fall to the bottom of the sack. The sack is then removed and disposed of, and a fresh sack is installed onto the scoop.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A refuse collecting device adapted to removably secure a disposable sack, said device comprising:

a) a scoop of rectangular box-like configuration comprised of upper and lower panels and opposed side panels, said panels having exterior surfaces and inner surfaces which define an interior region of the scoop having a center axis of elongation, said panels terminating in coplanar forward edges which define a rectangular front opening, and coplanar back edges defining a rectangular rear opening, b) at least one sack-securing means associated with the exterior surface of each side panel, c) an elongated manipulating staff having proximal and distal extremities, said proximal extremity being pivotally secured to said upper panel adjacent said front opening, the manner of securement permitting a path of movement of said staff within a plane that includes said axis, and d) handle means orthogonally associated with the distal extremity of said staff and downwardly directed therefrom in a manner to lie within said path of movement.

2. The device of claim 1 wherein said sack-securing means is an outwardly and rearwardly directed hook.

3. The device of claim 1 wherein said box-like configuration is further characterized in having four parallel corner edges.

4. The device of claim 3 wherein the widths of the panels, measured orthogonally between respective corner edges, is between 6 and 12 inches.

5. The device of claim 4 wherein the length of the scoop, measured axially between said front and rear openings, is between 7 and 12 inches.

6. The device of claim 5 wherein the site of securement of the staff to the scoop is such that, when the device is lifted by said handle means, said scoop will automatically swing by gravity effect, causing said front opening to become upwardly directed.

7. In combination, the device of claim 6 and a plastic grocery sack fabricated of thin film and provided with paired carrying handles as integral components of the sack, said carrying handles being removably engaged by said sack-securing means, said sack being further disposed forwardly upon said exterior surfaces over said front opening and inwardly into said interior region.

* * * * *